United States Patent [19]

Stock

[11] 4,421,093

[45] Dec. 20, 1983

[54] DRAW STOP MECHANISM FOR A COMPOUND ARCHERY BOW

[75] Inventor: Carl R. Stock, Bridgeton, Mo.

[73] Assignee: ACCRA Manufacturing Co., Broken Arrow, Okla.

[21] Appl. No.: 382,601

[22] Filed: May 27, 1982

[51] Int. Cl.[3] ..... F41B 5/00

[52] U.S. Cl. ..... 124/86

[58] Field of Search ..... 124/23 R, 24 R, 86, 124/90, 80

[56] References Cited

U.S. PATENT DOCUMENTS 4,185,374 1/1980 Shepley ..... 124/90 X

*Primary Examiner*—Richard J. Apley
*Assistant Examiner*—William R. Browne
*Attorney, Agent, or Firm*—W. Scott Carson

[57] ABSTRACT

A draw stop mechanism for a compound archery bow. The draw stop mechanism includes first and second draw stop members with each stop member being fixedly secured to one pass of the bow string and slidingly receiving an adjacent pass. In operation, for example, with a compound bow having at least three passes of the bow string through its pulley system between the ends of the bow, the first and second draw stop members are respectively secured to two of the three passes. Then, as the third pass is drawn back causing the bow string to move through the pulley system, the first and second passes move by each other in opposite directions until the first and second stop members abut one another. When they abut, the bow string has been drawn to the desired length. If a longer or shorter draw length is desired, one or both of the stop members can be selectively moved to other secured positions along the respective passes. With the draw stop mechanism of the present invention, a reliable and positive stop is provided serving to improve the archer's accuracy by enabling him to consistently repeat the same draw length on the bow.

10 Claims, 5 Drawing Figures

DRAW STOP MECHANISM FOR A COMPOUND ARCHERY BOW

FIELD OF THE INVENTION

This invention relates to the field of archery accessories and more particularly to the field of draw stops for compound bows.

BACKGROUND OF THE INVENTION

A major advance in the design of archery equipment was the compound bow. As compared to the more conventional bow designs (e.g., long bows, recurve bows) in which a single length of bow string is strung between the ends of the bow, a compound bow uses a pulley system and makes multiple passes of the bow string between the ends of the bow. For example, a typical compound bow has one or more pulley wheels mounted on each end of the bow and makes at least three passes of the bow string through the pulley system between the ends of the bow. With a compound bow, the archer is able to use the mechanical advantage of the pulley system to obtain a significant force advantage over the more conventional bow designs.

Although the design of a compound bow is quite different, it still presents most of the same problems in shooting technique to an archer including requiring a uniform draw length for best operation. Many draw length aids available for conventional bows (e.g., clickers, optical mirrors) can also be used with compound bows; however, because of the unique design of the compound bow including its pulley wheels and multiple passes of the bow string, it offers an opportunity for the development of draw stops tailored to this unique design. As of this time, the only known draw stop specifically for a compound bow includes a spoke extending outwardly of one of the pulley wheels wherein the spoke rotates with the wheel and abuts the end of the bow upon the archer reaching the desired draw length. Although such a draw stop is available for compound bows, it is not believed that any draw stop using the multiple passes of the bow string is known and it was with this in mind that the present invention was developed. With the draw stop of the present invention, the multiple passes of the bow string of the compound bow (and in particular, the fact that at least two of the passes typically move in opposite directions relative to each other as the bow string is drawn) are used to create a positive, draw stop mechanism uniquely suited for use with a compound bow.

SUMMARY OF THE INVENTION

This invention involves a draw stop mechanism for a compound archery bow. The draw stop includes first and second stop members respectively mounted to two of the passes of the bow string through the pulley system of the compound bow. In the preferred embodiment, the first stop member is fixedly secured to one pass of the bow string at a first predetermined location along it and includes a guiding means that slidingly receives a second pass of the bow string. In a like manner, the second stop member is fixedly secured to the second pass of the bow string at a second predetermined location along it and also includes a guiding means that slidingly receives the first pass of the bow string.

In operation, a third pass of the bow string is drawn back causing the bow string to move through the pulley system wherein the first and second passes move by each other in opposite directions until the first and second stop members abut one another. When they abut, the bow string has then been drawn to the desired length. If a longer or shorter draw length is desired, one or both of the stop members can be selectively moved to other secured positions along the respective passes. In this manner, the archer is able to set his own desired draw length and is positively prevented from drawing beyond it. Once the draw stop mechanism is in place, the archer can then consistently repeat the same draw length for maximum accuracy.

DETAILED DESCRIPTION OF THE PREFERRED EMBODIMENTS

Figure 1:
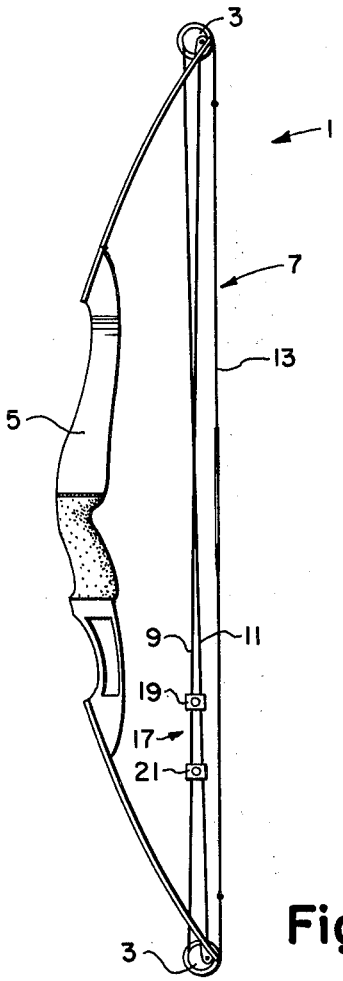
FIG. 1 is a side view of a typical compound bow in which the draw stop mechanism of the present invention is mounted on two of the three passes of the bow string through the pulley system of the compound bow.
Figure 2:
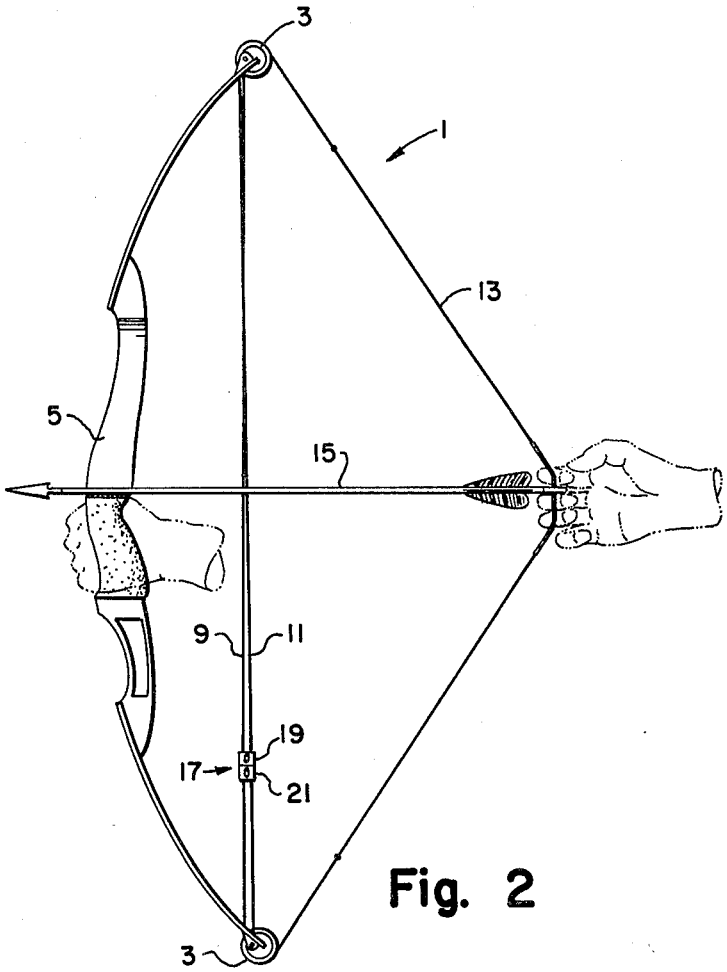
FIG. 2 is a view similar to FIG. 1 illustrating the operation of the draw stop mechanism in which the two stop members abut one another in a predetermined manner when the bow string is drawn to the desired full length by the archer.

A typical compound bow 1 as illustrated in FIG. 1 includes two pulley wheels 3 rotably mounted adjacent each end of the bow 5 with the bow string 7 secured to each end of the bow and making three passes 9, 11, and 13 through the pulley system. In the more typical case, passes 9 and 11 of the bow string 7 are actually made of cable for strength and durability while the third pass 13 which receives the arrow 15 and is drawn back as shown in FIG. 2 is made of plastic or other conventional material. However, in operation through the pulley system, the bow string 7 acts as a single length of cord.

Figure 3:
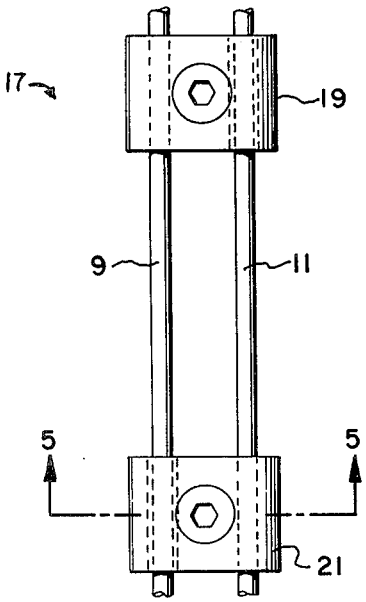
FIG. 3 is an enlarged view of the draw stop members illustrating the manner in which they are respectively mounted to one pass of the bow string and slidably receive an adjacent pass of the bow string.
Figure 4:
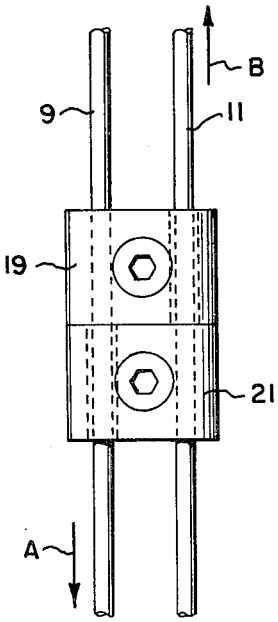
FIG. 4 is an enlarged view illustrating the manner in which the draw stop members are moved toward each other as the bow string is drawn (see FIGS. 1 and 2) until they abut one another at a predetermined draw position of the bow string.
Figure 5:
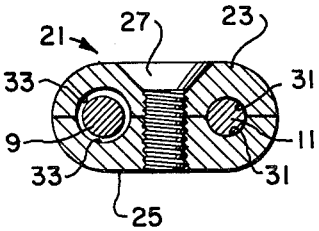
FIG. 5 is a view along line 5—5 of FIG. 3 illustrating the manner in which each draw stop member is fixedly secured to one pass of the bow string and includes a guiding means which slidingly receives an adjacent pass of the bow string. With the structure of FIG. 5, the archer can adjust the position of one or both of the draw stop members along the respective passes of the bow string to selectively lengthen or shorten the full draw position as desired.

As best seen in FIGS. 1–4, the passes 9 and 11 of the bow string 7 are substantially parallel to each other and move by one another in opposite directions as the third pass 13 is drawn back (see direction arrows A and B in FIG. 4). As best illustrated in FIGS. 3–5, the draw stop mechanism 17 includes first and second draw stop members 19 and 21. The stop members 19 and 21 are preferably identical in design and are fixably secured to one pass (11 in FIG. 5) of the bow string 7 and slidably received an adjacent pass (9 in FIG. 5) of the bow string 7. In the preferred embodiment of FIG. 5, this is accomplished by screwing the two halves 23 and 25 together with screw 27 wherein the half circle indentions 31 in the corresponding surfaces of the members 23 and 25 meet or substantially meet and fixedly engage pass 11 while the larger half circle indentions 33 on members 23 and 25 substantially enclose the pass 9 in a sliding or guiding relationship. Preferably, the passes 9 and 11 have circular cross sections and the radius of the full circle formed by indentions 31 in stop member 21 is slightly less than the radius of pass 11 and the radius of the full circle formed by indentions 33 is slightly greater than that of pass 9 as shown in FIG. 5.

In operation and with draw stop member 19 secured to pass 9 and slidingly receiving pass 11 and with draw stop member 21 secured to pass 11 and slidingly receiving pass 9, the third pass 13 of the bow string 7 is drawn back. This action in turn moves passes 9 and 11 by each other in opposite directions (see direction arrows A and B of FIG. 4) and moves draw stop members 19 and 21 toward each other until they abut (FIG. 4). At this point, the archer has drawn the bow string 7 to the desired length and is ready to release the arrow 15. If the archer wishes to shorten or lengthen the draw, he has only to loosen screw 27 (FIG. 5) on one or both of the draw stop members 19 and 21 and move them along the respective passes 9 and 11. The draw stop mechanism 17 provides a reliable and positive stop to the archer and serves to improve his accuracy. Further, the draw stop mechanism 17 can be used with most compound bow designs including those using symmetrically mounted pulley wheels or eccentrically mounted ones.

While several embodiments of the present invention have been illustrated and described in detail, it is to be understood that modifications can be made to these designs without departing from the scope of the invention.

I claim:

1. A compound archery bow comprising:

a bow member having two ends, at least one pulley wheel and means for mounting said pulley wheel adjacent one end of said bow member, bow string and means for mounting said bow string to make at least three passes between the ends of said bow member with respective portions of said first and second passes extending adjacent one another between the two ends of said bow member and moving in opposite directions as said third pass is drawn, and draw stop, said draw stop including first and second stop members, means on said first stop member for fixedly securing said first stop member to said first pass at a first predetermined location along said associated portion thereof between said bow member ends, and means on said second stop member for fixedly securing said second stop member to said second pass at a second predetermined location said associated portion thereof between said bow member ends whereby said first and second stop members are moved toward one another as said third pass of said bow string is drawn and abut one another at a predetermined draw position of said bow string.

2. The compound bow of claim 1 wherein said first stop member includes means for guiding said second pass during the latter's movement when as said bow string is drawn.

3. The compound archery bow of claim 2 wherein said guiding means of said first stop member includes means for substantially enclosing said second pass of said bow string in a sliding relationship as said first and second passes move by each other in said opposite directions as said third pass is drawn.

4. The compound archery bow of claim 1 wherein said first stop member includes means for selectively securing said first stop member to said first pass whereby the relative spacing between the first and second stop members can be adjusted to selectively increase or decrease the distance the third pass can be drawn before the first and second stop members abut one another.

5. The compound archery bow of claim 1 wherein said first and second stop members include means for guiding the respective second and first passes by one another as said bow string means is drawn.

6. The compound archery bow of claim 5 wherein said guiding means of said first and second stop members include means for substantially enclosing the respective first and second passes of said bow string in respective sliding relationships as said first and second passes move by each other in said opposite directions as said third pass is drawn.

7. The compound archery bow of claim 1 wherein said first and second stop members include means for selectively securing the respective first and second stop members to the respective first and second passes whereby the relative spacing between the first and second stop members can be adjusted to selectively increase or decrease the distance the third pass can be drawn before the first and second stop members abut one another.

8. The compound archery bow of claim 1 further including a second pulley wheel and means for mounting said second pulley wheel adjacent the other end of said bow member.

9. The compound archery bow of claim 1 wherein said mounting means for said pulley wheel includes means for eccentrically mounting said pulley wheel adjacent said one end of said bow member.

10. The compound archery bow of claim 1 wherein said first and second passes have substantially circular cross sections and said first stop member includes first and second halves and means for selectively securing said halves together, said halves having corresponding surfaces with corresponding, substantially half circle indentions therein whereby said corresponding half circle indentions form substantially full circles when said halves are secured together, said full circles having different radii with the radius of the smaller full circle being slightly less than the radius of curvature of said first pass and the radius of the larger full circle being slightly greater than the radius of said second pass.

* * * * *